US011289281B1

(12) United States Patent
Chang et al.

(10) Patent No.: US 11,289,281 B1
(45) Date of Patent: Mar. 29, 2022

(54) KEY STRUCTURE

(71) Applicant: Primax Electronics Ltd., Taipei (TW)

(72) Inventors: Chia-Wei Chang, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/239,330

(22) Filed: Apr. 23, 2021

(30) Foreign Application Priority Data

Mar. 19, 2021 (TW) ..... 110110108

(51) Int. Cl.
*H01H 3/12* (2006.01)
*H01H 13/7057* (2006.01)

(52) U.S. Cl.
CPC ..... *H01H 3/125* (2013.01); *H01H 13/7057* (2013.01)

(58) Field of Classification Search
CPC ..... H01H 13/14; H01H 13/83; H01H 3/125; H01H 13/04; H01H 13/7065; H01H 13/704; H01H 13/86; H01H 13/70; H01H 13/50; H01H 2215/004; H01H 13/20; H01H 3/12; H01H 13/22; H01H 2003/008
See application file for complete search history.

(56) References Cited

U.S. PATENT DOCUMENTS 5,488,210 A * 1/1996 Shigetaka ..... H01H 3/125 200/344
9,941,071 B1 * 4/2018 Chen ..... H01H 13/36
10,276,328 B1 * 4/2019 Cheng ..... H01H 13/52
2001/0033269 A1 * 10/2001 Hosoya ..... H01H 3/125 345/168

* cited by examiner

*Primary Examiner* — Ahmed M Saeed
(74) *Attorney, Agent, or Firm* — Kirton McConkie; Evan R. Witt

(57) ABSTRACT

A key structure includes a keycap and a scissors-type connecting element. The scissors-type connecting element is connected with the keycap. The scissors-type connecting element includes an inner frame and an outer frame. A first end of the inner frame is connected with the keycap. The outer frame is connected with the inner frame and swingable relative to the inner frame. A first end of the outer frame is connected with the keycap and located near a second end of the inner frame. A second end of the inner frame includes a first protrusion. A first end of the outer frame includes a second protrusion near the first protrusion. The first protrusion includes a first knocking surface. The second protrusion includes a second knocking surface. While the keycap is pressed down, the first knocking surface and the second knocking surface knock on each other.

13 Claims, 9 Drawing Sheets

KEY STRUCTURE

FIELD OF THE INVENTION

The present invention relates to a key structure, and more particularly to a key structure with a scissors-type connecting element.

BACKGROUND OF THE INVENTION

Generally, the common peripheral input device of a computer system includes for example a mouse device, a keyboard device, or the like. Via the keyboard device, characters or symbols can be inputted into the computer system directly. As a consequence, most users pay much attention to the keyboard devices.

When the key structure of a mechanical keyboard is clicked, a click sound and a feedback are generated. However, some existing keyboard devices (e.g., a slim keyboard of a notebook computer) cannot generate the sound and the feedback. When the consumer purchases a keyboard device, the sound and the feedback performance of the keyboard device are usually important factors that are taken into consideration.

Therefore, there is a need of providing a keyboard device capable of generating a sound and a feedback like a clicked mechanical keyboard.

SUMMARY OF THE INVENTION

In accordance with an aspect of the present invention, a key structure is provided. The key structure includes a keycap and a scissors-type connecting element. The scissors-type connecting element is connected with the keycap. The scissors-type connecting element includes an inner frame and an outer frame. A first end and a second end of the inner frame are opposed to each other. The first end of the inner frame is connected with the keycap. The outer frame is connected with the inner frame and swingable relative to the inner frame. A first end and a second end of the outer frame are opposed to each other. The first end of the outer frame is connected with the keycap and located near the second end of the inner frame. The second end of the inner frame includes a first protrusion. The first end of the outer frame includes a second protrusion near the first protrusion. The first protrusion includes a first knocking surface. The second protrusion includes a second knocking surface. While the keycap is pressed down, the first knocking surface and the second knocking surface knock on each other.

In an embodiment, the second end of the inner frame further includes a first elastic arm, and the first elastic arm is connected with the first protrusion.

In an embodiment, the second end of the inner frame further includes an opening. The opening is adjacent to the first elastic arm. The first elastic arm is arranged between the opening and the first protrusion.

In an embodiment, there is an overlapped region between a vertical projection region of the first protrusion and a vertical projection region of the second protrusion. Moreover, a width of the opening is larger than or equal to a width of the overlapped region.

In an embodiment, the opening is a closed-type hollow region.

In an embodiment, the first knocking surface is a top surface of the first protrusion, and the first knocking surface is coplanar with a top surface of the first elastic arm.

In an embodiment, the first protrusion has a first slant surface between the first knocking surface and an outer surface of the first elastic arm.

In an embodiment, the first end of the outer frame further includes a second elastic arm, and the second elastic arm is connected with the second protrusion.

In an embodiment, the second knocking surface is a bottom surface of the second protrusion, and the second knocking surface is coplanar with a bottom surface of the second elastic arm.

In an embodiment, the second protrusion has a second slant surface between the second knocking surface and an inner surface of the second elastic arm.

In an embodiment, the first protrusion and the second protrusion have trapezoidal, triangular, L-shaped, semi-circular or semi-elliptic cross sections.

In an embodiment, the first protrusion and the second protrusion have right-angled trapezoid cross sections.

In an embodiment, the key structure further includes an elastic element, and the elastic element is connected with the keycap. While the keycap is pressed down, the elastic element is compressed, and the inner frame and the outer frame are swung relative to each other. When the keycap is no longer pressed down, the keycap is returned to an original position in response to an elastic force of the elastic element.

From the above descriptions, the inner frame and the outer frame of the scissors-type connecting element of the present invention are equipped with the first protrusion and the second protrusion, respectively. While the keycap is pressed down, the first protrusion and the second protrusion knock on, push against and rub against each other to generate a sound. As the keycap is continuously pressed down, the inner frame and the outer frame are switched to the stacked state, and the positions of the first protrusion and the second protrusion are exchanged. When the keycap is released and no longer pressed down, the inner frame with the first protrusion and the outer frame with the second protrusion are returned to their original positions, and another sound is generated. Consequently, when the key structure of the present invention is pressed down, the key structure can generate the sound and the feedback similar to that the mechanical keyboard presents when it is clicked. In other words, the key structure of the present invention can meet the requirements of consumers.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

As mentioned above, some existing keyboard devices cannot generate the sound and the feedback that the mechanical keyboard presents when it is clicked. Therefore, there is a need of providing a keyboard device capable of generating the sound and the feedback that the mechanical keyboard presents when it is clicked. The present invention provides a key structure in order to overcome the drawbacks of the conventional technologies. Some examples of the key structure of a keyboard device will be described as follows.

Figure 1:
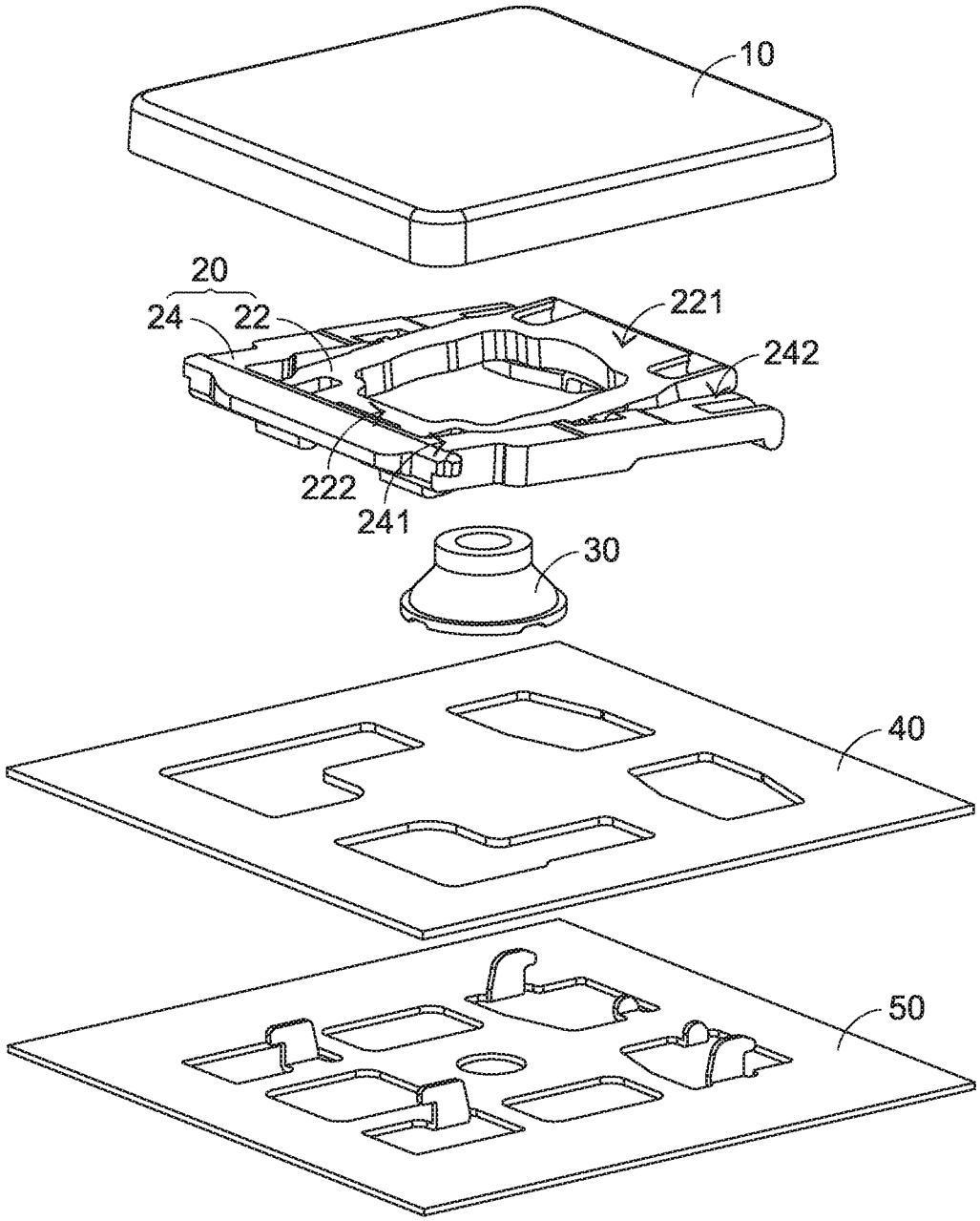
FIG. 1 is a schematic exploded view illustrating a key structure according to an embodiment of the present invention.

The keyboard device comprises plural key structures. FIG. 1 is a schematic exploded view illustrating a key structure according to an embodiment of the present invention. As shown in FIG. 1, the key structure comprises a keycap 10 and a scissors-type connecting element 20. The scissors-type connecting element 20 is connected with the keycap 10. In addition, the scissors-type connecting element 20 comprises an inner frame 22 and an outer frame 24.

As shown in FIG. 1, the key structure further comprises an elastic element 30. The elastic element 30 is connected with the keycap 10. While the keycap 10 is pressed down, the elastic element 30 is compressed, and the inner frame 22 and the outer frame 24 are swung relative to each other. When the keycap 10 is no longer pressed down, the keycap 10 is returned to its original position in response to an elastic force of the elastic element 30. Accordingly, the inner frame 22 and the outer frame 24 are returned to their original positions.

Please refer to FIG. 1 again. In an embodiment, the keyboard device further comprises a membrane circuit board 40 in addition to the key structure. The membrane circuit board 40 is located under the key structure. In some embodiments, the membrane circuit board 40 comprises plural film layers and membrane switches. The plural film layers are arranged in a stack form.

Please refer to FIG. 1 again. In an embodiment, the keyboard device further comprises a base plate 50 in addition to the key structure. The scissors-type connecting element 20 is connected between the keycap 10 and the base plate 50. The elastic element 30 is arranged between the keycap 10 and the base plate 50.

While the keycap 10 of the key structure is pressed down and moved downwardly relative to the base plate 50, the inner frame 22 and the outer frame 24 of the scissors-type connecting element 20 are switched from an open-scissors state to a stacked state. Moreover, as the keycap 10 is moved downwardly to compress the elastic element 30, the corresponding membrane switch is pushed and triggered by a contacting part of the elastic element 30. Consequently, the keyboard device generates a corresponding key signal. When the keycap 10 of the key structure is no longer pressed down, the keycap 10 is moved upwardly relative to the base plate 50 in response to the elastic force of the elastic element 30. Meanwhile, the inner frame 22 and the outer frame 24 of the scissors-type connecting element 20 are switched from the stacked state to the open-scissors state, and the keycap 10 is returned to its original position.

Figure 2:
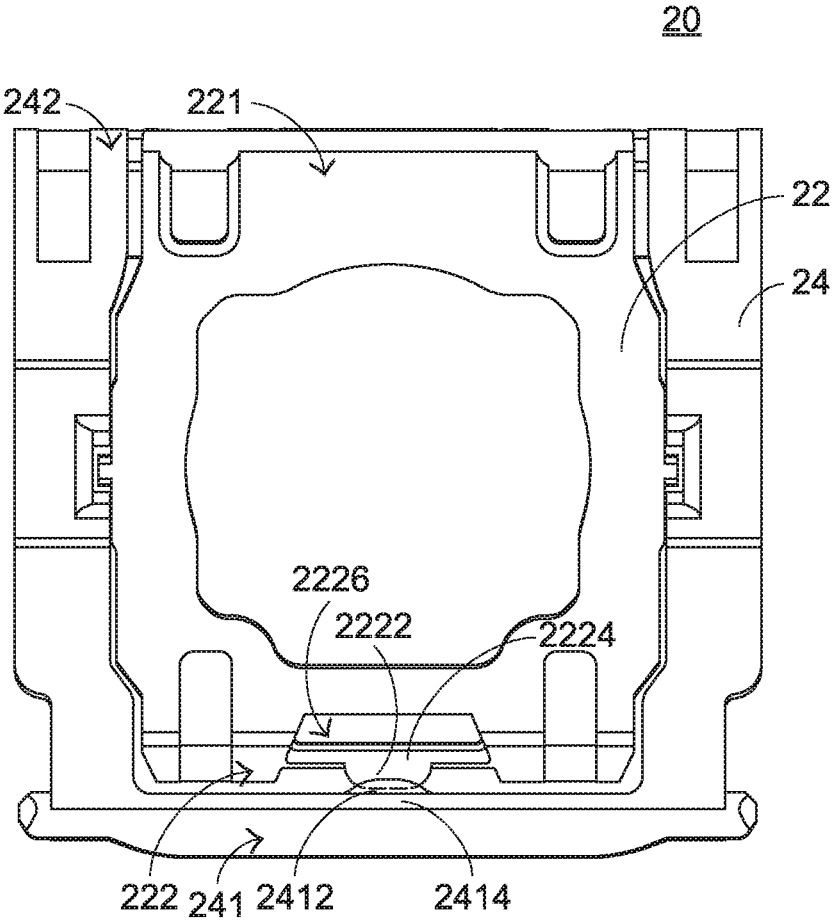
FIG. 2 is a schematic top view illustrating the scissors-type connecting element of the key structure according to the embodiment of the present invention.

FIG. 2 is a schematic top view illustrating the scissors-type connecting element of the key structure according to the embodiment of the present invention. As shown in FIGS. 1 and 2, the inner frame 22 has a first end 221 and a second end 222, which are opposed to each other. The first end 221 of the inner frame 22 is connected with the keycap 10. The second end 222 of the inner frame 22 is connected with the base plate 50. The second end of the inner frame 22 comprises a first protrusion 2222.

Please refer to FIGS. 1 and 2 again. The outer frame 24 is combined with the inner frame 22 and swingable relative to the inner frame 22. Moreover, the outer frame 24 has a first end 241 and a second end 242, which are opposed to each other. The first end 241 of the outer frame 24 is connected with the keycap 10 and located near the second end 222 of the inner frame 22. The second end 242 of the outer frame 24 is connected with the base plate 50. The first end 241 of the outer frame 24 comprises a second protrusion 2412. The second protrusion 2412 is located near the first protrusion 2222. When the keycap 10 is not pressed down, the vertical projection region of the first protrusion 2222 and the vertical projection region of the second protrusion 2412 are partially overlapped with each other.

Please refer to FIG. 2 again. In an embodiment, the second end 222 of the inner frame 22 further comprises a first elastic arm 2224. The first elastic arm 2224 is connected with the first protrusion 2222. When an external force is applied to the first elastic arm 2224, the first elastic arm 2224 is subjected to elastic deformation. After the external force is eliminated, the first elastic arm 2224 is restored to its original shape. In an embodiment, the first protrusion 2222 and the first elastic arm 2224 are integrally formed as one-piece structure. Alternatively, the first protrusion 2222 and the first elastic arm 2224 are separate components and assembled with each other. Moreover, the first protrusion 2222 and the first elastic arm 2224 are made of the same material or different materials.

Please refer to FIG. 2 again. In an embodiment, the second end 222 of the inner frame 22 further comprises an opening 2226. The opening 2226 is adjacent to the first elastic arm 2224. Moreover, the first elastic arm 2224 is arranged between the opening 2226 and the first protrusion 2222. The opening 2226 is configured to provide a movable space for the first elastic arm 2224. Preferably but not exclusively, the opening 2226 is a closed-type hollow region. The profile of the opening may be varied according to the practical requirement. For example, in another embodiment, a first end of the first elastic arm is connected with the second end of the inner frame, and a second end of the first elastic arm is not connected with the second end of the inner frame. In other words, the opening is an open-type hollow region.

Please refer to FIG. 2 again. In an embodiment, the first end 241 of the outer frame 24 further comprises a second elastic arm 2414. The second elastic arm 2414 is connected with the second protrusion 2412. When an external force is applied to the second elastic arm 2414, the second elastic arm 2414 is subjected to elastic deformation. After the external force is eliminated, the second elastic arm 2414 is restored to its original shape. In an embodiment, the second protrusion 2412 and the second elastic arm 2414 are integrally formed as one-piece structure. Alternatively, the second protrusion 2412 and the second elastic arm 2414 are separate components and assembled with each other. Moreover, the second protrusion 2412 and the second elastic arm 2414 are made of the same material or different materials.

Figure 3:
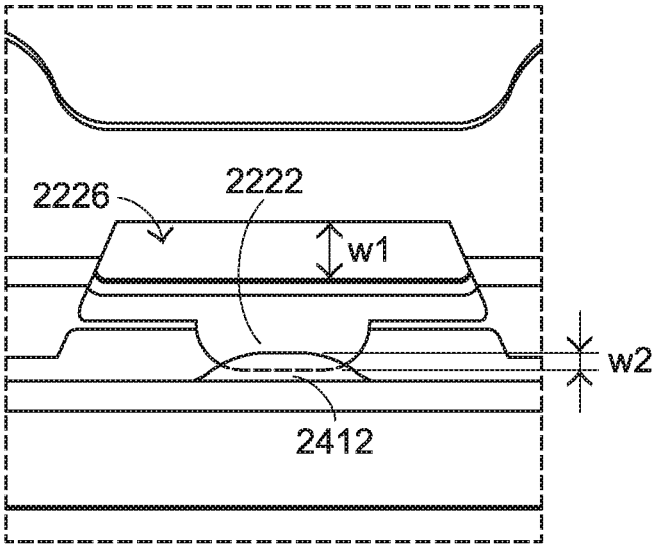
FIG. 3 is a schematic enlarged view illustrating a portion of the scissors-type connecting element as shown in FIG. 2.

FIG. 3 is a schematic enlarged view illustrating a portion of the scissors-type connecting element as shown in FIG. 2. As shown in FIG. 3, the vertical projection region of the first protrusion 2222 and the vertical projection region of the second protrusion 2412 are partially overlapped with each other. More especially, the width w1 of the opening 2226 is larger than or equal to the width w2 of the overlapped region between the vertical projection region of the first protrusion 2222 and the vertical projection region of the second protrusion 2412.

Figure 4:
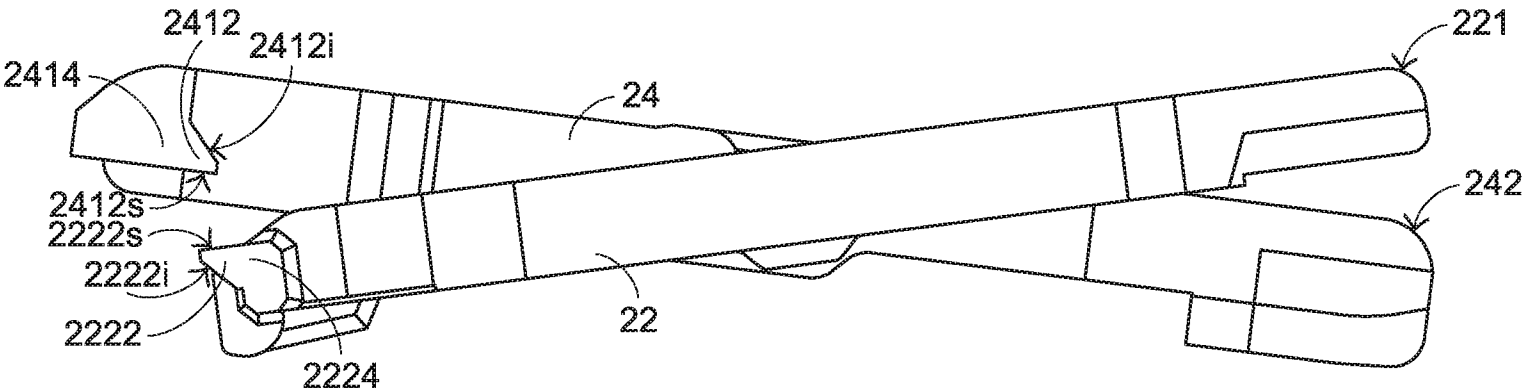
FIG. 4 is a schematic side view illustrating the scissors-type connecting element as shown in FIG. 2.

FIG. 4 is a schematic side view illustrating the scissors-type connecting element as shown in FIG. 2. As shown in FIGS. 2 and 4, the first protrusion 2222 comprises a first knocking surface 2222*s*, and the second protrusion 2412 comprises a second knocking surface 2412*s*. While the keycap is pressed down, the first protrusion 2222 of the inner frame 22 and the second protrusion 2412 of the outer frame 24 are moved toward each other, and then the first knocking surface 2222*s* and the second knocking surface 2412*s* knock on each other.

In some embodiments, the first protrusion 2222 and the second protrusion 2412 have trapezoidal, triangular, L-shaped, semi-circular or semi-elliptic cross sections. The shapes and positions of the cross sections of the first protrusion and the second protrusion are not restricted as long as they are permitted to collide with each other. In the embodiment of FIG. 4, the first protrusion and the second protrusion have right-angled trapezoid cross sections.

Please refer to FIG. 4 again. Preferably but not exclusively, the first knocking surface 2222*s* is a top surface of the first protrusion 2222, and the first knocking surface 2222*s* is coplanar with a top surface of the first elastic arm 2224. Preferably but not exclusively, the second knocking surface 2412*s* is a bottom surface of the second protrusion 2412, and the second knocking surface 2412*s* is coplanar with a bottom surface of the second elastic arm 2414.

Preferably but not exclusively, the first protrusion 2222 has a first slant surface 2222*i* between the first knocking surface 2222*s* and an outer surface of the first elastic arm 2224. Preferably but not exclusively, the second protrusion 2412 has a second slant surface 2412*i* between the second knocking surface 2412*s* and an inner surface of the second elastic arm 2414.

Hereinafter, the operations of the key structure in different stages will be described.

Figure 5:
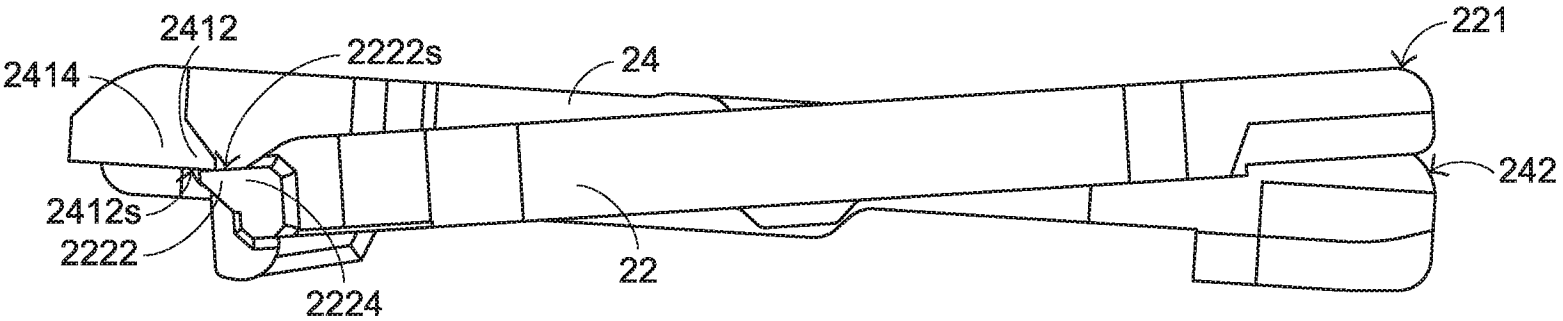
FIG. 5 is a schematic side view illustrating the scissors-type connecting element as shown in FIG. 4 when the keycap is pressed down.

FIG. 5 is a schematic side view illustrating the scissors-type connecting element as shown in FIG. 4 when the keycap is pressed down. While the keycap 10 is pressed down, the first protrusion 2222 and the second protrusion 2412 are moved toward each other, and then the first knocking surface 2222*s* and the second knocking surface 2412*s* knock on each other.

Figure 6:
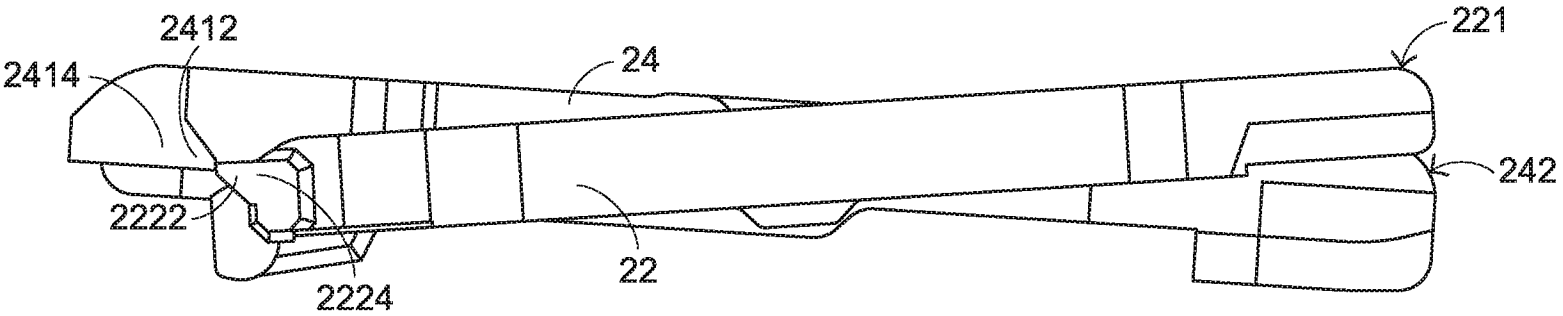
FIG. 6 is a schematic side view illustrating the scissors-type connecting element as shown in FIG. 5 when the keycap is continuously pressed down.
Figure 7:
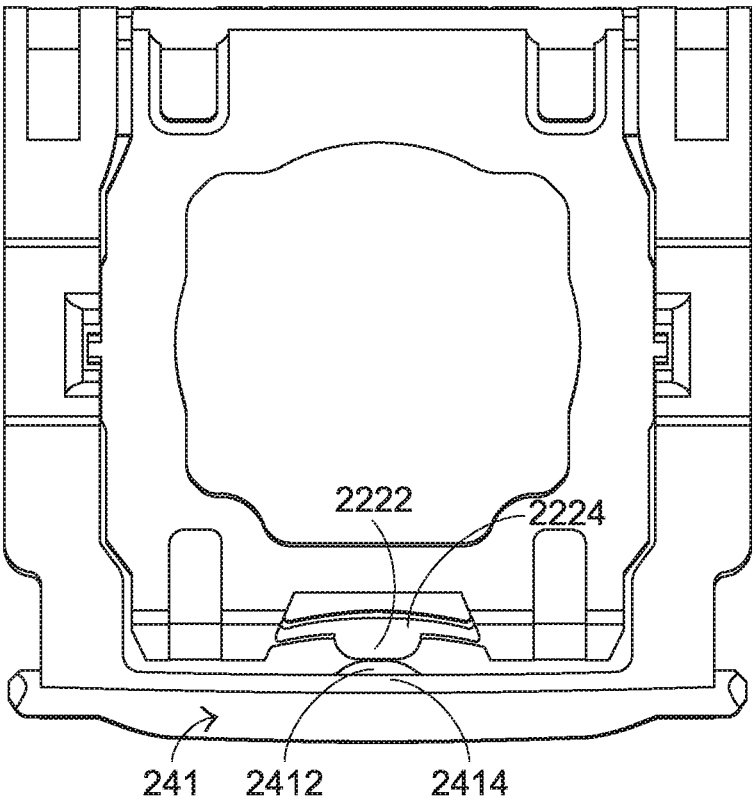
FIG. 7 is a schematic top view illustrating the scissors-type connecting element as shown in FIG. 6.

FIG. 6 is a schematic side view illustrating the scissors-type connecting element as shown in FIG. 5 when the keycap is continuously pressed down. FIG. 7 is a schematic top view illustrating the scissors-type connecting element as shown in FIG. 6. Please refer to FIGS. 5, 6 and 7. As the keycap 10 is continuously pressed down, the first elastic arm 2224 deforms in the direction toward the first end 221 of the inner frame 22 and/or the second elastic arm 2414 deforms in the direction toward the first end 241 of the outer frame 24. When the vertex of the first protrusion 2222 and the vertex of the second protrusion 2412 are pushed and rubbed against each other, a sound is generated.

Figure 8:
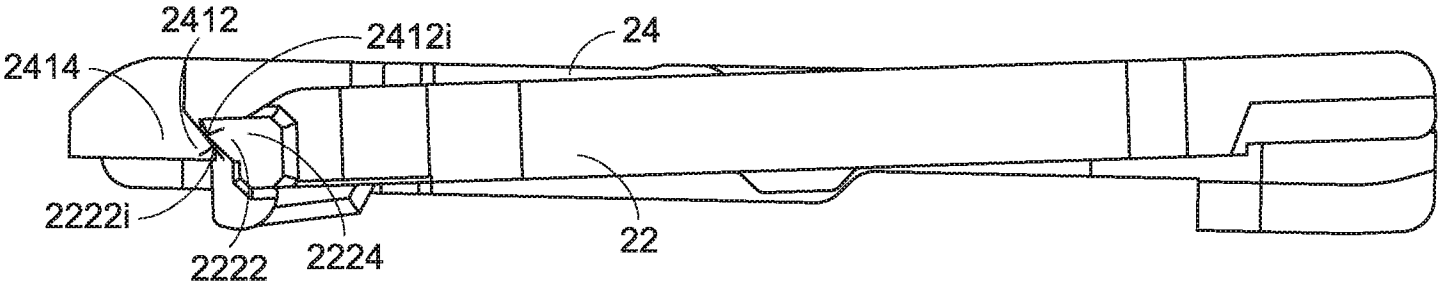
FIG. 8 is a schematic side view illustrating the scissors-type connecting element as shown in FIG. 6 when the keycap is continuously pressed down.
Figure 9:
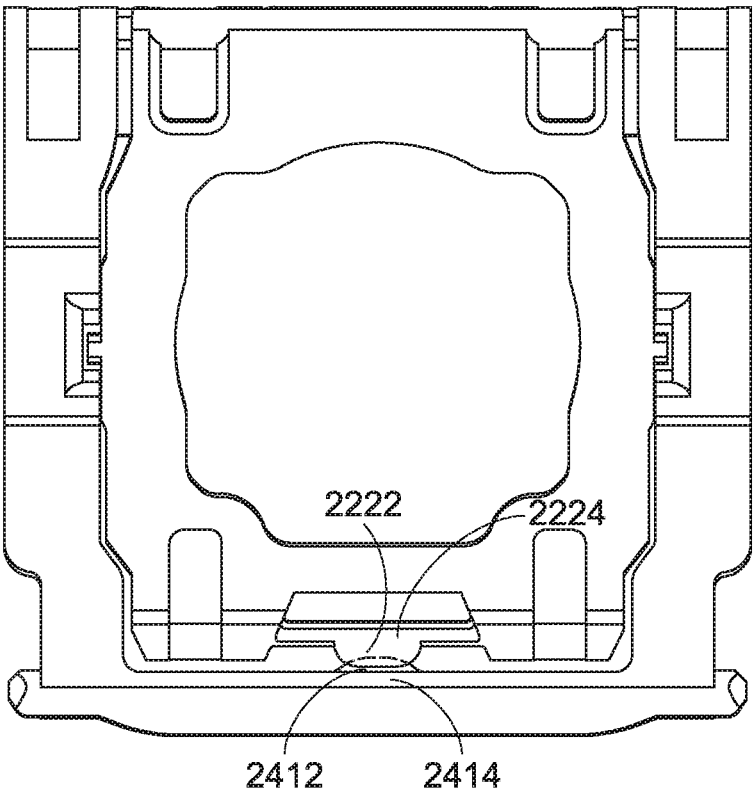
FIG. 9 is a schematic top view illustrating the scissors-type connecting element as shown in FIG. 8.

FIG. 8 is a schematic side view illustrating the scissors-type connecting element as shown in FIG. 6 when the keycap is continuously pressed down. FIG. 9 is a schematic top view illustrating the scissors-type connecting element as shown in FIG. 8. Please refer to FIGS. 6, 8 and 9. As the keycap 10 is continuously pressed down, the inner frame 22 and the outer frame 24 of the scissors-type connecting element 20 are switched to the stacked state. Under this circumstance, the keycap 10 is pressed down to the bottom-most position, and the keycap 10 is maintained in the flat state. Meanwhile, the positions of the first protrusion 2222 and the second protrusion 2412 are exchanged, and the first slant surface 2222*i* and the second slant surface 2412*i* are stacked on each other. Particularly, the first slant surface 2222*i* is stacked over the second slant surface 2412*i*. In addition, the first elastic arm 2224 and/or the second elastic arm 2414 is restored to the original shape.

Please refer to FIG. 8 and FIG. 4. When the keycap 10 is released and no longer pressed down, the keycap 10 is pushed by the elastic force of the elastic element 30. At the same time, the first slant surface 2222*i* of the first protrusion 2222 is slid downwardly along the second slant surface 2412*i*, and the first elastic arm 2224 and/or the second elastic arm 2414 is subjected to slight deformation. Consequently, the inner frame 22 and the outer frame 24 are returned to their original positions, and another sound is generated.

From the above descriptions, the present invention provides the key structure. The first protrusion and the second protrusion knock on, push against and rub against each other to generate the sound. The sound generated by the key structure of the present invention is similar to the sound when the mechanical keyboard is clicked. After the positions of the first protrusion and the second protrusion are exchanged, a sound is generated when the first protrusion and the second protrusion are returned to the original positions. Consequently, the feedback performance of the key structure of the present invention is similar to that the mechanical keyboard presents when it is clicked. Moreover, the key structure of the present invention also provides the feedback tactile feel of the elastic element.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap; and a scissors-type connecting element connected with the keycap, wherein the scissors-type connecting element comprises an inner frame and an outer frame, wherein a first end and a second end of the inner frame are opposed to each other, and the first end of the inner frame is connected with the keycap, wherein the outer frame is connected with the inner frame and swingable relative to the inner frame, and a first end and a second end of the outer frame are opposed to each other, and the first end of the outer frame is connected with the keycap and located near the second end of the inner frame, wherein the second end of the inner frame comprises a first protrusion, and the first end of the outer frame comprises a second protrusion near the first protrusion, and the first protrusion comprises a first knocking surface, and the second protrusion comprises a second knocking surface, wherein while the keycap is pressed down, the first knocking surface and the second knocking surface knock on each other.

2. The key structure according to claim 1, wherein the second end of the inner frame further comprises a first elastic arm, and the first elastic arm is connected with the first protrusion.

3. The key structure according to claim 2, wherein the second end of the inner frame further comprises an opening, wherein the opening is adjacent to the first elastic arm, and the first elastic arm is arranged between the opening and the first protrusion.

4. The key structure according to claim 3, wherein there is an overlapped region between a vertical projection region of the first protrusion and a vertical projection region of the second protrusion, and a width of the opening is larger than or equal to a width of the overlapped region.

5. The key structure according to claim 3, wherein the opening is a closed-type hollow region.

6. The key structure according to claim 2, wherein the first knocking surface is a top surface of the first protrusion, and the first knocking surface is coplanar with a top surface of the first elastic arm.

7. The key structure according to claim 6, wherein the first protrusion has a first slant surface between the first knocking surface and an outer surface of the first elastic arm.

8. The key structure according to claim 1, wherein the first end of the outer frame further comprises a second elastic arm, and the second elastic arm is connected with the second protrusion.

9. The key structure according to claim 8, wherein the second knocking surface is a bottom surface of the second protrusion, and the second knocking surface is coplanar with a bottom surface of the second elastic arm.

10. The key structure according to claim 9, wherein the second protrusion has a second slant surface between the second knocking surface and an inner surface of the second elastic arm.

11. The key structure according to claim 1, wherein the first protrusion and the second protrusion have trapezoidal, triangular, L-shaped, semi-circular or semi-elliptic cross sections.

12. The key structure according to claim 1, wherein the first protrusion and the second protrusion have right-angled trapezoid cross sections.

13. The key structure according to claim 1, wherein the key structure further comprises an elastic element, and the elastic element is connected with the keycap, wherein while the keycap is pressed down, the elastic element is compressed, and the inner frame and the outer frame are swung relative to each other, wherein when the keycap is no longer pressed down, the keycap is returned to an original position in response to an elastic force of the elastic element.

* * * * *